United States Patent [19]

Mueller

[11] 4,027,684

[45] June 7, 1977

[54] PERMANENT-WAVE OR WATER-WAVE CURLER

[76] Inventor: Siegfried Mueller, Max-Reger-Weg 3, 7737 Bad Buerrheim, Germany

[22] Filed: Nov. 10, 1975

[21] Appl. No.: 630,258

[30] Foreign Application Priority Data

Nov. 15, 1974 Germany ..... 7438190
Jan. 18, 1975 Germany ..... 2501935

[52] U.S. Cl. ..... 132/40
[51] Int. Cl.[2] ..... A45P 2/00
[58] Field of Search ..... 132/40, 42, 39, 33, 132/9, 39

[56] References Cited

UNITED STATES PATENTS

| | | | |
|---|---|---|---|
| 2,565,673 | 8/1951 | Yven et al. | 132/39 |
| 3,461,884 | 8/1969 | Augusta | 132/42 R |
| 3,470,888 | 10/1969 | Kuhn | 132/40 |
| 3,805,812 | 4/1974 | Lee | 132/39 |

*Primary Examiner*—G.E. McNeill
*Attorney, Agent, or Firm*—Woodhams, Blanchard and Flynn

[57] ABSTRACT

A permanent-wave or water-wave curler having an elongated cylindrical curler body with at least one holding body arranged at one end coaxially of the curler body axis. The holding body is greater in diameter than the curler body and has two axially spaced and radially extending flanges. The flanges have a resilient characteristic and substantially equal diameters to thereby define an annular groove therebetween. At least one of the flanges has a thickness slightly larger than the axial spacing between the two flanges so that when the one flange is inserted under force into a groove of an adjacent curler, the flanges on the adjacent curler will flex to permit entry of the one flange therebetween and effect a friction holding of the one flange against a rotation relative to the two flanges defining the groove.

10 Claims, 6 Drawing Figures

PERMANENT-WAVE OR WATER-WAVE CURLER

FIELD OF THE INVENTION

The invention concerns a permanent-wave or water-wave curler with an essentially cylindrical curler body having holding bodies arranged at both its ends coaxially of the curler body axis, which holding bodies are greater in diameter than the curler body, and by engagement in the holding bodies of one or more adjacent curlers hold together the curlers of equal length arranged parallel to each other.

BACKGROUND OF THE INVENTION

In making permanent waves or water waves, the hair is first softened by the use of an appropriate solution, is then wound around curlers of different sizes and is finally dried. In order that the hair will not unwind again off the curler, or in order that the curler will be held on the hair, it is known to use a rubber band which is suspended from one end of the curler and is stretched over the hair to the other end of the curler. The application of the rubber band to the softened hair causes pressure marks and damage to the hair.

For this reason, permanent-wave or water-wave curlers of the aforesaid type are known (see U.S. Pat. No. 3,474,797) having a holding member at each end of the curler body. In these known permanent-wave or water-wave curlers, the holding members consist of wide rings, which have the elements of a "hook-and-eye" fastener on their outer periphery. This means that one ring is provided on its external periphery with a plurality of hooks, while the other ring has a plurality of eyes. Apart from the fact that such hook-and-eye rings are expensive to make and can also easily come loose from the curler body, they also have the disadvantage that hair and other foreign bodies can adhere fast in the hooks and eyes, so that the hook-and-eye fastener gradually becomes unserviceable. The constant heating effect during the drying of the permanent waves or water waves is also a contributory factor.

In addition, when winding the hair on the curler, care must be taken to turn the curler always into a position such that a ring with hooks and a ring with eyes always lie opposite one another, otherwise the hook-and-eye principle does not function. This disadvantage has already been recognized and an attempt has been made to remove it by arranging on one end of each curler body three rings, two of which have hooks and the third has eyes. Then, on the other end of the curler body two rings were provided with eyes and a third with hooks. In this way, however, the known permanent-wave or water-wave curler was still more expensive to make, and in addition the width over which the rings or two adjacent curlers were in engagement was reduced. In order, nevertheless, to obtain a satisfactory holding effect, the hook-and-eye fastener rings had to be comparatively wide, resulting in a correspondingly greater overall length of the permanent-wave or water-wave curler for a relatively shorter useful length of the actual curler body. In the case of friseurs, in which very many curlers have to be used, the large overall length of the known curlers is very troublesome.

The object of the invention is to provide a permanent-wave or water-wave curler of the aforesaid kind, which is essentially simpler in its construction and therefore cheaper to manufacture, has a shorter overall length and at the same time ensures with certainty the holding together of two adjacent curlers.

This is achieved according to the invention in that as holding bodies, there are provided on the end of the curler body two flanges arranged at an axial distance apart, said flanges having substantially equal thickness and substantially equal diameters and forming a annular groove between themselves the width of which groove is somewhat smaller than the thickness of a flange, so that a flange of an adjacent curler can be pressed into the said groove with a wedging effect.

The permanent-wave or water-wave curler according to the invention is characterized by a particularly simple construction, high durability and trouble-free manipulation. The two flanges provided at each end of the curler body are particularly simple to manufacture. They may consist, for example, of plastics material and may be of one piece with the curler body. No hair or other foreign bodies can become attached to the comparatively smooth surfaces of the flanges. In addition, they are not affected by the heat used in drying the permanent-wave or water-wave. By pressing the flange of one curler into the annular groove between the flanges of the other curler, two or more curlers with hair wound on them can be securely held simply by the wedging effect. Manipulation is very simple since the construction of the curlers is the same at both ends, so that is does not matter on which side any particular end lies. When pressing the flanges into one another, the curlers merely have to be offset relatively to each other in the axial direction by the thickness of a flange. Since the flanges may also be made relatively thin, the curler has a slight overall length, the actual useful length of the curler body being very large in proportion to the overall length. Consequently, in the case of complicated friseurs very many curlers can be used without their interfering with each other. The curlers according to the invention furthermore have the advantage, which is also shared by the known curlers mentioned in the preamble, i.e. that the hair is dealt with extremely carefully and no pressure marks or hair damage whatsoever can occur.

BRIEF DESCRIPTION OF THE DRAWINGS

The invention is described more fully in the following with reference to three embodiments represented by way of example in the accompanying drawings, in which.

DETAILED DESCRIPTION

Figure 1:
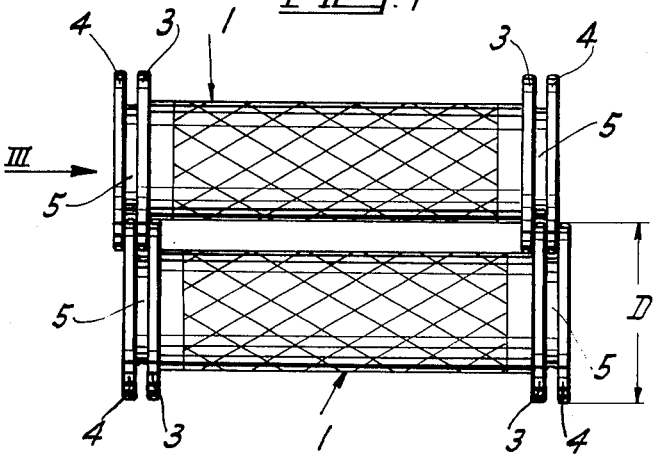
FIG. 1 shows a plan view of two interengaged water-wave curlers in actual size.

In the drawings, 1 denotes an essentially cylindrical curler body, which may be provided in known manner with a number of openings 2. Two flanges 3 and 4 arranged at an axial distance apart and having the same axial thickness are provided on both ends of the curler body. Between the two flanges 3 and 4 is an annular slot 5. The width *b* of this annular groove is somewhat less than the thickness *d* of a flange so that, as shown in FIG. 1, a flange of a neighboring curler can always be pressed into the annular groove 5 with a wedging effect. So that this system can function at both ends of the curler, the two curlers must have an equal axial length. Furthermore, the diameter D of flanges 3 and 4 should be greater than the maximum diameter of the curler body.

The parts of the curler body 1 bounding the inner flange 3 should have a diameter W which is less than the diameter of the flanges by at least twice the mutual depth of engagement *e* of the flanges. This ensures that the flanges of adjacent curlers always have the necessary depth of engagement.

Advantageously, the flanges 3,4 and possibly also the curler body, are made of resilient plastics material. This makes simple manufacture possible. In addition, the curler is then also insensitive to the chemical substances used in making permanent-waves and water-waves.

Figure 3:
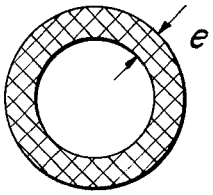
FIG. 3 shows one end of a water-wave curler viewed in the direction III of FIG. 1.
Figure 2:
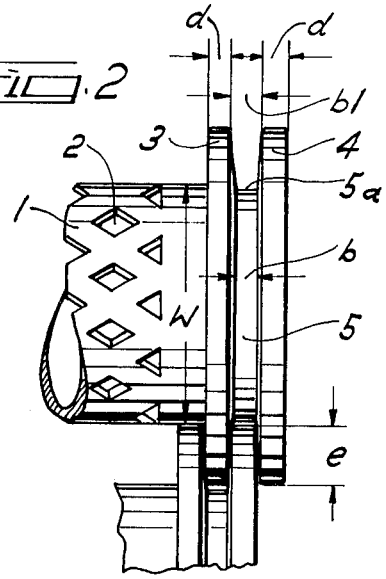
FIG. 2 shows a part plan view of the end of one of these curlers on a larger scale.

So that the curlers, when fitted together, will also be held securely by the wedging effect of their flanges, it is preferable if the plastics material is roughened in the region of the depth of engagement *e* of the flanges. This is shown diagrammatically in FIG. 3 by cross-hatching.

To facilitate fitting together of the adjacent curlers, it is preferable if the annular groove 5 in its outer region has a width *b*1 slightly larger than the thickness *d* of the flanges. The annular groove, however, tapers towards the bottom 5*a* so that there the width *b* is less than the thickness *d* of the flanges. In this way, two adjacent curlers can at first be fitted lightly together by their flanges, in which case the resistance and also the wedging effect increases with increasing insertion of the flanges into the annular groove.

Figure 4:
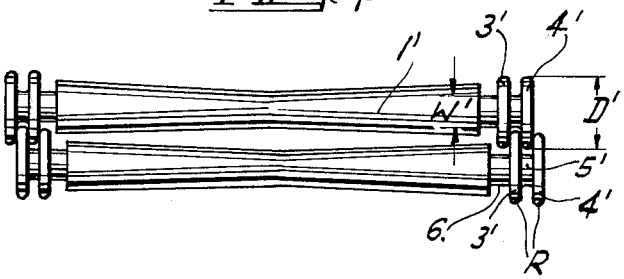
FIG. 4 shows a plan view of two interengaged permanent-wave curlers.

Furthermore, in order to facilitate the fitting together of the flanges, it is advantageous to round off the said flanges at their outer edge. Such rounding R is more particularly advantageous in the case of the flanges 3′ and 4′, shown in FIG. 4, of the permanent-wave curlers also shown. In the case of these permanent-wave curlers in which the curler body 1′ has a comparatively small diameter, in order that the flanges 3′ and 4′ can interengage with sufficient depth of engagement while nevertheless not having a diameter which is excessively large, the curler body 1′ in the region adjoining the inner flange 3′ has a narrow part 6 with a diameter W′ which, as was described in the foregoing, is less than the diameter D′ of the flanges by at least twice the mutual depth of engagement of the flanges 3′ and 4′.

Figure 5:
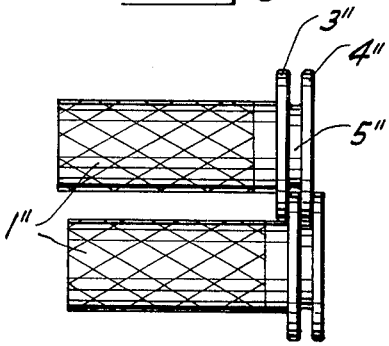
FIG. 5 shows in plan view a further embodiment example.

A further embodiment example is represented in FIG. 5. In this embodiment example, the curler body 1″ has two flanges 3″ and 4″ only at one end, these flanges in other respects being formed exactly like the flanges of the first embodiment example. Owing to the excellent wedging effect of the flanges 3″ and 4″ and their large engagement depth, it is sufficient in special cases if the flanges are provided at one end only of the curler body. The flanges not only hold the fitted curlers together but also keep them axially parallel. The curlers shown in FIG. 5 may be used in both the flat position, i.e. with their axis parallel to the surface of the head, or also upright, i.e. at right angles to the surface of the head. In this case, the curlers are then so arranged that the curler body is directed towards the head, while the flanges are turned away from the surface of the head. In the upright use of these curlers, the hair remains flatter on the head and can be coiled in a natural wave form. With the curlers known hitherto this has not been possible without pressure marks in the hair.

Figure 6:
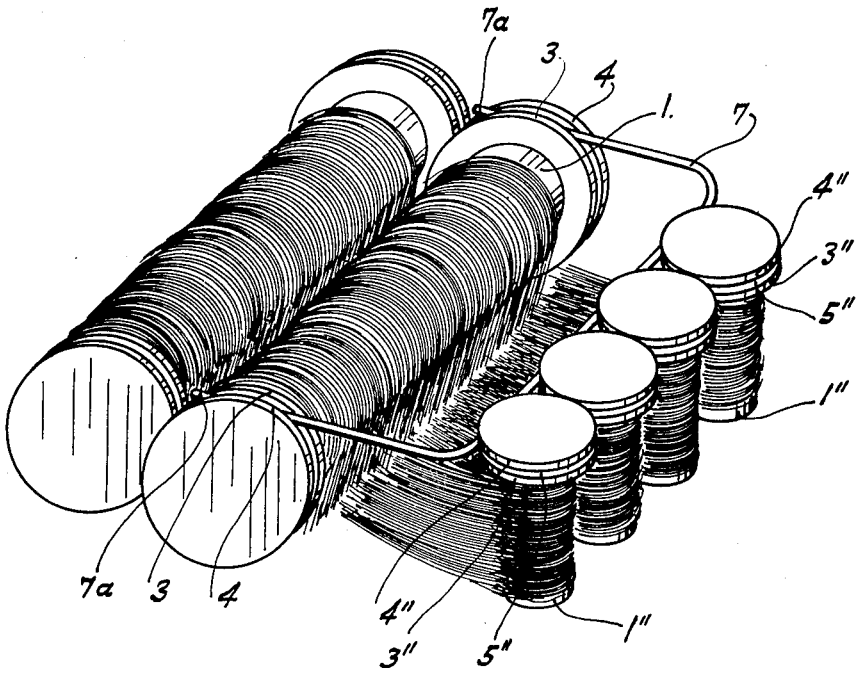
FIG. 6 shows a wire clip used with the new curlers.

With the upright arrangement of the curler provided with flanges only on one side, in order to prevent overturning of the curler, it is expedient to use the flexible wire clip 7 shown in FIG. 6, the diameter of whose wire is slightly larger than the width of the annular groove 5 or 5″. The free ends 7*a* of the clip are pressed into the grooves 5 of the last curler lying flat on the head. It is then possible, as shown in the drawing, to wedge on the remaining part of the clip, a number of curlers which are provided with flanges 3″ and 4″ only on one end by pressing the wire into the annular grooves 5′. Since the half-curlers are prevented from tilting over by the wire clip 7, the hair is treated in a particularly careful manner and pressure marks are prevented. If necessary, it would also be conceivable to clamp only one or two half-curlers on the wire clip 7, and to clamp the other half-curlers by mutual fitting to the half-curlers already clamped to the clip.

The embodiments of the invention in which an exclusive property or privilege is claimed are defined as follows:

1. In a permanent-wave or water-wave curler having an elongated cylindrical curler body with at least one holding body, said holding body being arranged at one end coaxially of the curler body axis, said holding body being greater in diameter than said curler body, the improvement comprising wherein said holding body has two axially spaced and radially extending flanges, said flanges having a resilient characteristic and substantially equal diameters to thereby define an annular groove therebetween, at least one of said flanges having a thickness slightly larger than said axial spacing between said two flanges, whereby when said one flange is inserted under force into a groove of an adjacent curler, said flanges on said adjacent curler will flex to permit entry of said one flange therebetween and effect a friction holding of said one flange against a rotation relative to said two flanges defining said groove.

2. An improved curler according to claim 1, wherein the part of said curler body adjacent the inner one of said flanges has a diameter which is smaller than the diameter of said flanges by at least double the mutual depth of engagement of said one flange into said groove.

3. An improved curler according to claim 1, wherein the flanges consist of a resilient plastics material.

4. An improved curler according to claim 3, wherein said plastics material is roughened in the region of said engagement depth between said flanges.

5. An improved curler according to claim 1, wherein said annular groove adjacent its outer region has a width which is slightly greater than the thickness of said one flange and wherein the width of the annular groove tapers toward the bottom.

6. An improved curler according to claim 1, wherein the flanges are rounded off on their outer edges.

7. An improved curler according to claim 1, wherein the flanges and said curler body are made in one piece.

8. An improved curler according to claim 1, wherein said curler body has two flanges only on one end.

9. An improved curler according to claim 8, wherein at least a pair of first curlers have flanges at opposite ends of said curler body and including a bent wire clip of flexible wire having a diameter which is slightly larger than the width of said annular groove, whereby the free ends of said wire clip can be pressed in between said flanges of said first curlers to define a support for said wire clip, and at least one other of said curlers provided only on one end with said flanges can be clamped in standing arrangement by their flanges engaging the remaining part of said wire clip.

10. An improved curler according to claim 1, wherein said curler body has one of said holding bodies at both ends thereof.

* * * * *